US005419630A

United States Patent [19]

Röck et al.

[11] Patent Number: 5,419,630

[45] Date of Patent: May 30, 1995

[54] DRAWER FRAME

[75] Inventors: Erich Röck, Höchst; Helmut Hollenstein, Lustenau, all of Austria

[73] Assignee: Julius Blum Gesellschaft m.b.H., Höchst, Austria

[21] Appl. No.: 50,655

[22] Filed: Apr. 22, 1993

[30] Foreign Application Priority Data

Apr. 30, 1992 [AT] Austria ..... 886/92
Oct. 15, 1992 [AT] Austria ..... 2032/92

[51] Int. Cl.[6] ..... A47B 88/00; A47B 95/00

[52] U.S. Cl. ..... 312/334.4; 312/334.5; 312/348.2

[58] Field of Search ..... 312/330.1, 334.4, 334.5, 312/348.2, 348.4, 348.1

[56] References Cited

U.S. PATENT DOCUMENTS 3,826,554 7/1974 Cornell ..... 312/348.1 X
4,778,230 10/1988 Lautenschlager ..... 312/334.5 X
4,832,420 5/1989 Rock et al. ..... 312/330.1 X
4,848,860 7/1989 Rock et al. ..... 312/330.1 X
4,872,735 10/1989 Rock et al. ..... 312/342
5,180,217 1/1993 Lautenschlager ..... 312/330.1 X
5,181,772 1/1993 Albiez ..... 312/348.2 X

FOREIGN PATENT DOCUMENTS 2402632 7/1975 Germany .
4016452 3/1991 Germany .
4123213 1/1992 Germany .

*Primary Examiner*—Edward K. Look
*Assistant Examiner*—Hoang Nguyen
*Attorney, Agent, or Firm*—Wenderoth, Lind & Ponack

[57] ABSTRACT

A drawer frame (12) made of sheet steel and having a lower supporting web (26), a vertical web (12') and an upper running web (23) is provided with a separate mounting (14) in which a three-dimensional panel (8) can be suspended. The panel (8) has a vertical cover web (8') located laterally spaced from the vertical web (12') of the drawer frame (12) in the mounted position.

29 Claims, 12 Drawing Sheets

1
2
3
4
5
6
7
8
9
10
11
12
23
24

DRAWER FRAME

The invention relates to a drawer frame made of metal and having a lower supporting web, a vertical web and an upper running web, having a three-dimensional panel which has a vertical cover web located laterally spaced from the vertical web of the drawer frame in the mounted position.

Drawer frames made of aluminium which are of two-wall construction and which are both attractive in shape and have a good stability and strength in use are known. Furthermore, single-wall steel frames have become known. These drawer frames are less expensive to produce than plastics frames. However, one of their disadvantages is that any securing apparatus, secured to the drawer frame, for a drawer front panel is not covered, which is regarded as disadvantageous aesthetically and, after a relatively long period, also results in soiling of the securing apparatus.

It is the object of the invention to provide an inexpensive drawer frame which has a high loading capacity and can be converted in a simple manner from a single-wall drawer frame to a double-wall drawer frame.

In accordance with the invention, this is achieved in that the drawer frame is of sheet steel, and separate mountings into which the panel can be inserted are secured to the drawer frame.

An embodiment of the invention provides for the panel to be displaceable in the mounting in the longitudinal direction of the drawer frame, it advantageously being provided for the mounting to be provided with a lug which projects into an opening in the panel. The lug can be arranged on a flexible tab in order to facilitate removal of the lug from the opening.

Thus, the panel according to the invention is displaceable on the drawer frame in the longitudinal direction so that a securing apparatus, secured to the drawer frame, for the drawer front panel can be released or covered as required. In the covered state, the lug of the mounting latches in the opening in the panel so that this panel is locked and cannot be taken out of this position unintentionally.

A particularly compact embodiment of the invention provides for the mounting to have an assembly web which bears against the supporting web at the bottom.

Various embodiments of the invention will be described below with reference to the figures of the attached drawings, in which:

FIGS. 1 and 2 each show a diagram of a drawer frame according to the invention and parts of the drawer, in FIG. 1 the panel being shown in the normal position, that is to say the position in which it covers a securing apparatus for a drawer front panel, and in FIG. 1 the panel being shown in the so-called mounted position in which the securing apparatus for the drawer front panel is free;

Figures 1, 2:
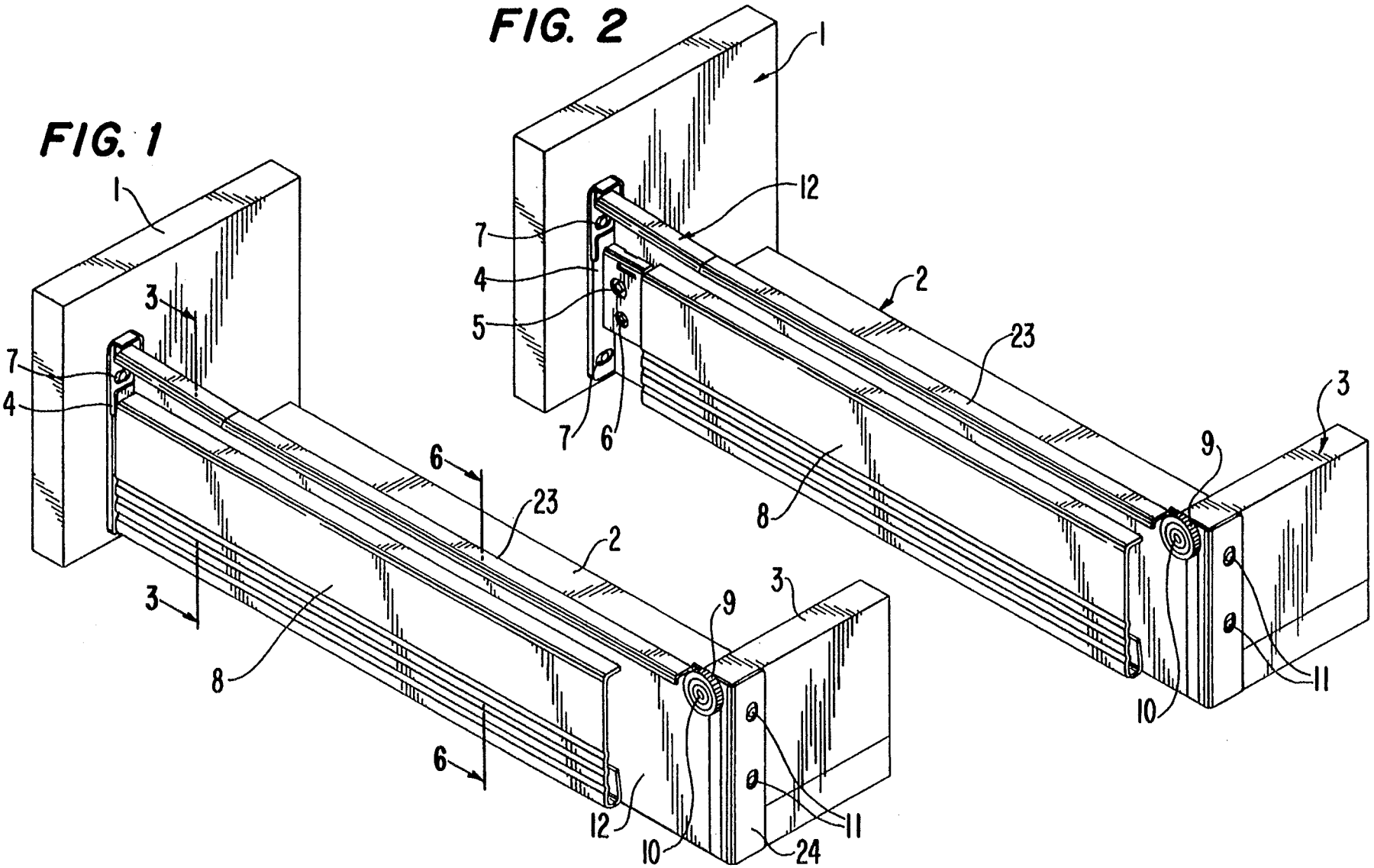

The drawer front panel bears the reference numeral 1, the drawer base bears the reference numeral 2 and the drawer rear wall bears the reference numeral 3.

The metal drawer frame, which is produced from sheet steel, has the reference numeral 12. The drawer frame 12 is provided at the front with a securing apparatus 4 for securing the drawer front panel 1. The drawer front panel 1 is connected by way of screws 7 to the securing apparatus 4. The securing apparatus 4 has a clamping screw 5 for tightening the drawer front panel 1 against the drawer frame 12, and a height adjustment means 6, for example an eccentric.

In order to adjust the height of the drawer front panel 1 or to fix the latter permanently to the drawer frame 12, it is necessary for the securing apparatus 4 not to be covered by the panel 8, and this is shown in FIG. 2. Here, it is desirable for the panel 8 to be displaceable along the drawer frame 12 in the longitudinal direction.

The panel 8 is arranged below the running web 23, which is integrally formed directly on the drawer frame 12.

At the rear end, the drawer frame 12 is provided with a running roller 9 which is mounted on a rivet 10. Furthermore, the drawer frame 12 has a securing angle piece 24 to which the drawer rear wall 3 is screwed by means of securing screws 11.

In the embodiment according to FIGS. 3 to 7, the panel 8 is merely provided with a lower L-shaped securing web 25.

A mounting 14 is secured to the front of the drawer frame 12 and a mounting 13 is secured to the rear. By way of example, the mountings 13, 14 are provided with an assembly web 25 which bears at the bottom against the supporting web 26 of the drawer frame 12 and through which securing screws, rivets or the like project.

Both mountings 13, 14 have a lower bearing web 27 and a hook part 28 arranged above it. The hook part 28 in this instance advantageously extends over the entire length of the mounting 13 or 14.

In order to improve positioning of the mounting 13 or 14 on the drawer frame 12, it is provided for a curved section 29 which is snugly received in a groove 30 in the mounting 13, 14 to be provided at the transition from the supporting web 26 to the vertical web 12' of the drawer frame 12.

The front mounting 14 is further provided with a lug 15 which is constructed on a resilient tab 31.

In the mounted position, the lug 15 projects into a corresponding opening in the lower web region 32 of the panel 8.

Figure 3:
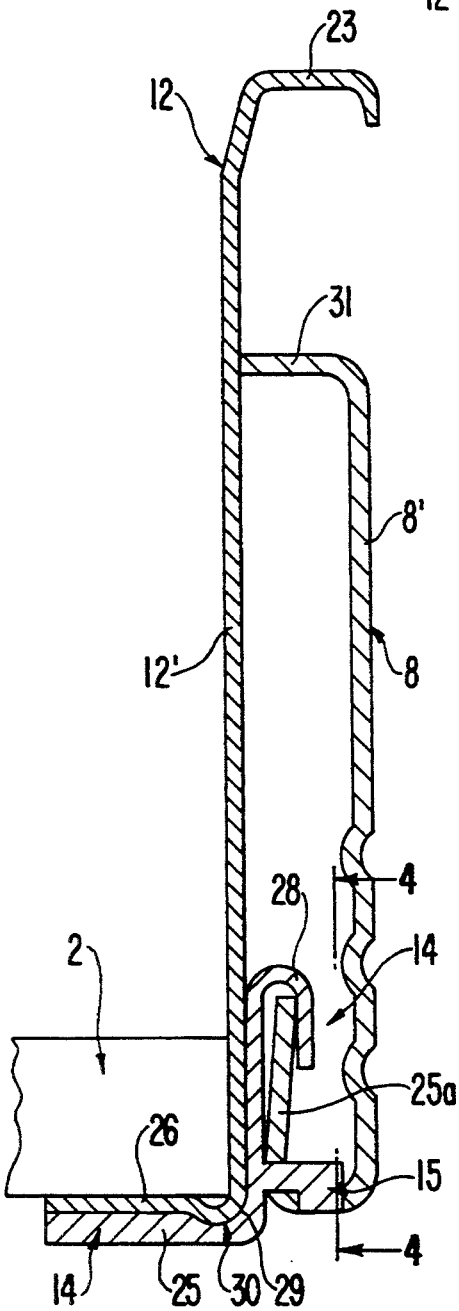
FIG. 3 shows a vertical section through an embodiment of a drawer frame according to the invention, in the region of part A in FIG. 1.
Figure 4:
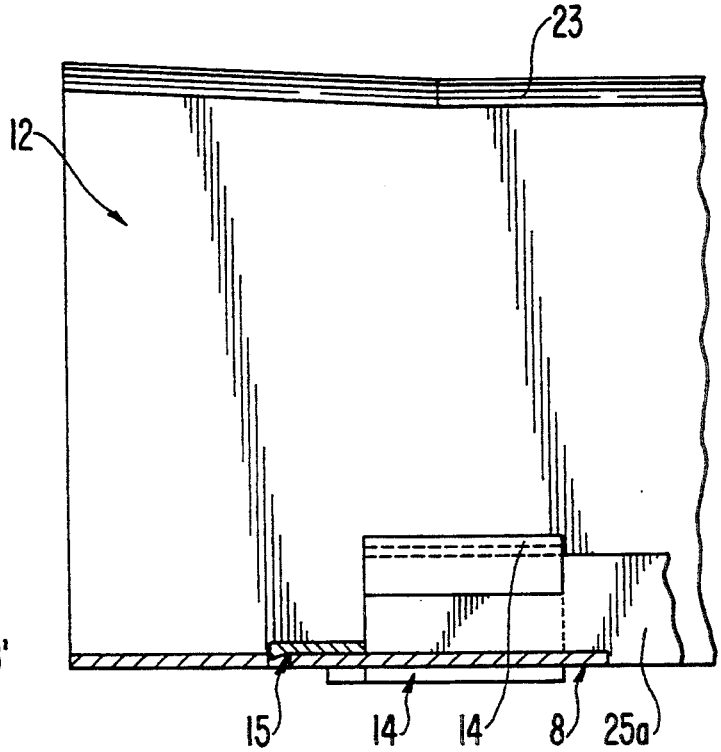
FIG. 4 shows a section along the line C—C in FIG. 4 [sic]
Figure 5:
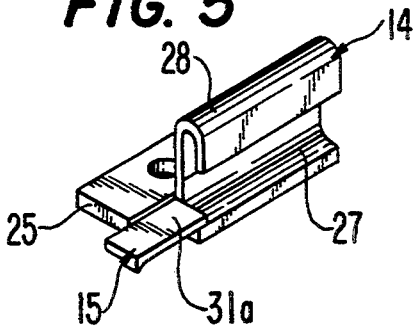
FIG. 5 shows a diagram of a mounting according to the invention.
Figure 6:
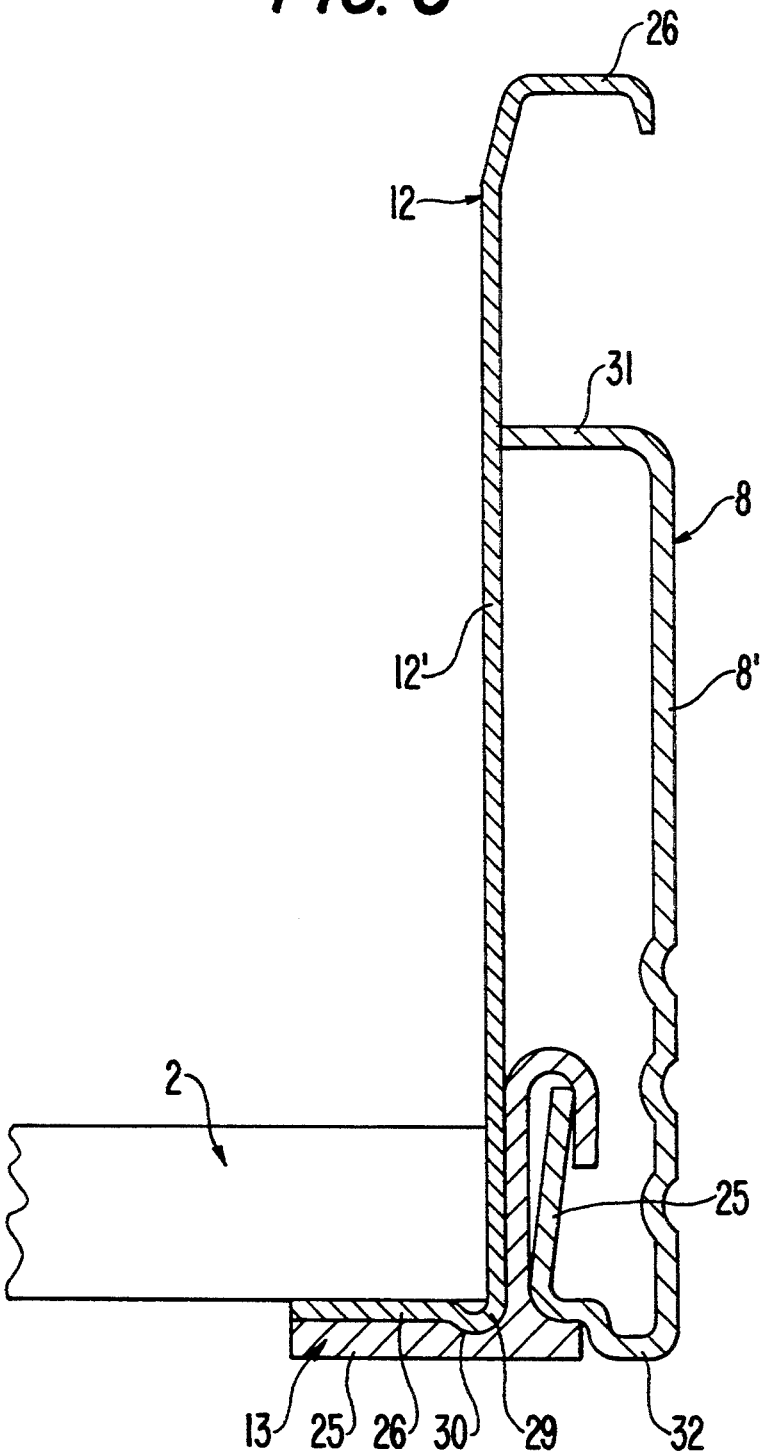
FIG. 6 shows a vertical section through a drawer frame in the region of the arrow B in FIG. 1.
Figure 7:
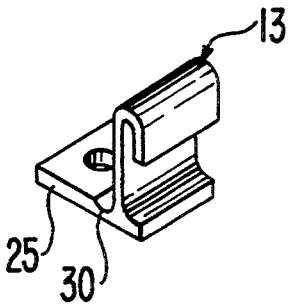
FIG. 7 shows a diagram of the mounting in this region.

As can be seen from FIGS. 3 and 6, for assembly the panel 8 is suspended in the mountings 13, 14 by means of its L-shaped edge web 25 such that it bears on the one hand on the bearing web 27 and is supported thereon and reaches on the other hand behind the hook part 28, so that the panel 8 is pressed by its own elasticity (the panel 8 is preferably produced from sheet steel) against the drawer frame 12 by means of its upper edge web 31.

While the lug 15 bears against the web 32, the panel 8 held in the mountings 13, 14 is displaceable in the longitudinal direction.

When the drawer front panel 1 has been mounted on the drawer or the drawer frames 12 and secured, the panel 8 is brought into the covering position shown in FIG. 1 and the lug 15 latches into the corresponding opening in the web 32. The panel 8 is thus prevented from displacement.

Figure 8:
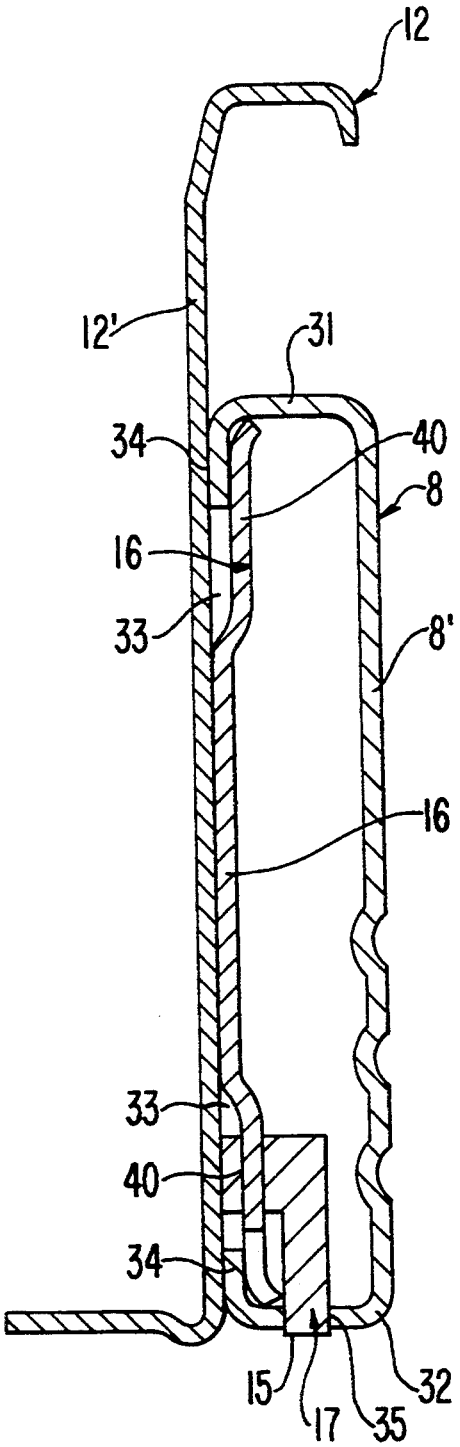
FIG. 8 shows a vertical section through a drawer frame in the region of the arrow A in FIG. 1, in accordance with a further embodiment of the invention.
Figure 9:
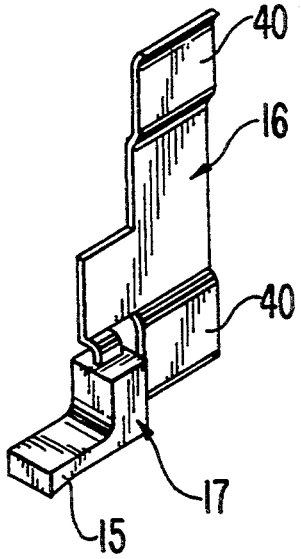
FIG. 9 shows a diagram of the mounting in the region of the arrow B in FIG. 1, in accordance with the same embodiment.
Figure 10:
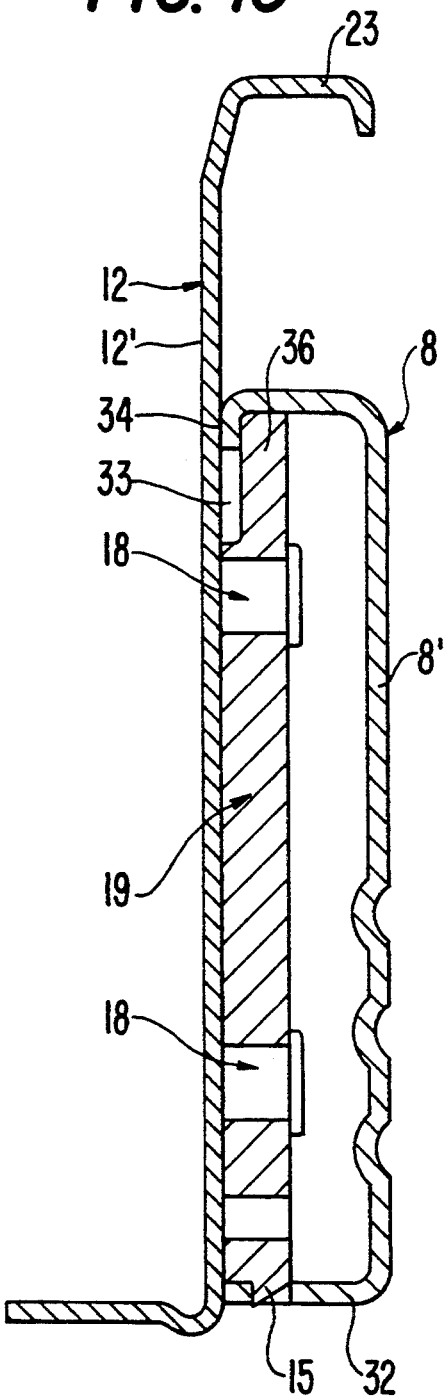
FIG. 10 shows a vertical section through a drawer frame in accordance with a further embodiment of the invention.
Figure 11:
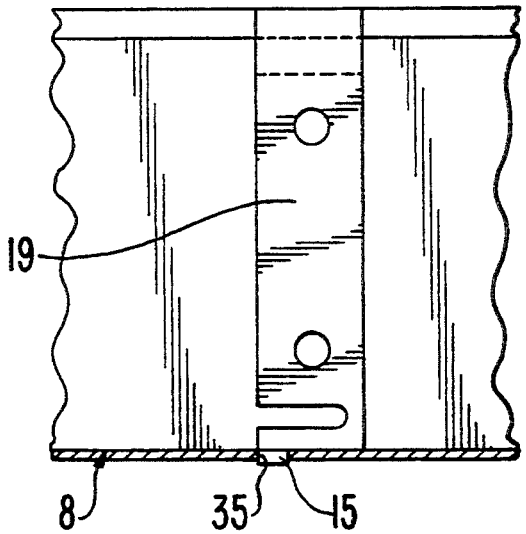
FIG. 11 shows a front view of the mounting in the region of the arrow A in FIG. 1.
Figure 12:
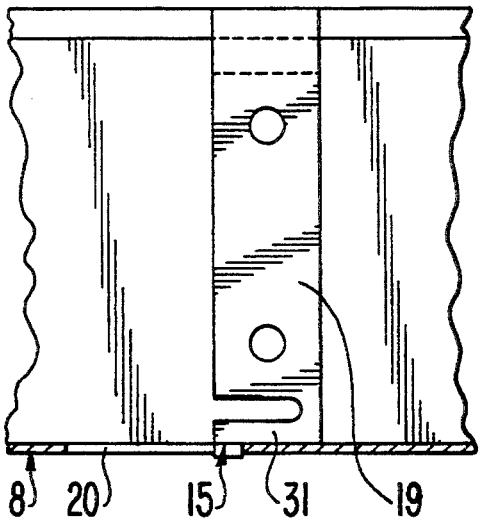
FIG. 12 shows a front view of the mounting in the region of the arrow B in FIG. 1.
Figure 13:
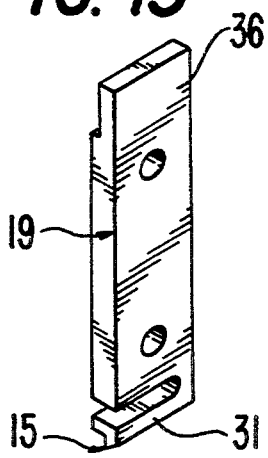
FIG. 13 shows a diagram of the mounting.

In the embodiment in accordance with FIGS. 8 and 9, the mounting 16 is formed by a resilient bracket. This resilient bracket has an upper and a lower holding web 32 which, together with the vertical web 12' of the drawer frame, each delimit a gap 33. An edge web 34 of the panel 8 projects into this gap 33 in each case, as a result of which the panel 8 is held against the drawer frame 12, again displaceably in the longitudinal direction.

On one of the mountings 16, preferably the mounting 16 arranged by the arrow in FIG. 1, there is a block 17 on which a lug 15 is in turn arranged. In the latching position, that is to say in the position in which the panel 8 covers the securing apparatus 4, the lug 15 latches into an opening 35 in the lower web 32 of the panel 8, as a result of which the latter is fixed.

In the embodiment in accordance with FIGS. 10 to 13, mountings 19 which are secured by means of rivets or the like 18 to the drawer frame 12 are provided.

At the top, the mountings 19 have a web 36 which, together with the vertical web 12' of the drawer frame, in turn delimits a gap 33. An edge web 34 of the panel 8 can be suspended in the gap 33.

At the bottom, each mounting 19 is in turn provided with a lug 15 which is constructed on a resilient tab 31.

The same mounting 19 is arranged both in the region of the arrow A in FIG. 1 and in the region of the arrow B.

However, in the region of the arrow A the lug 15 projects into an opening 35 which prevents the panel 8 from being displaced, while in the region of the arrow B the lug 15 projects into an elongate hole 20 which permits a predetermined displacement path for the panel.

Thus, for the panel 8 to be displaced it is simply necessary for the lug 15 in the front region to be released from the opening 35.

Figure 14:
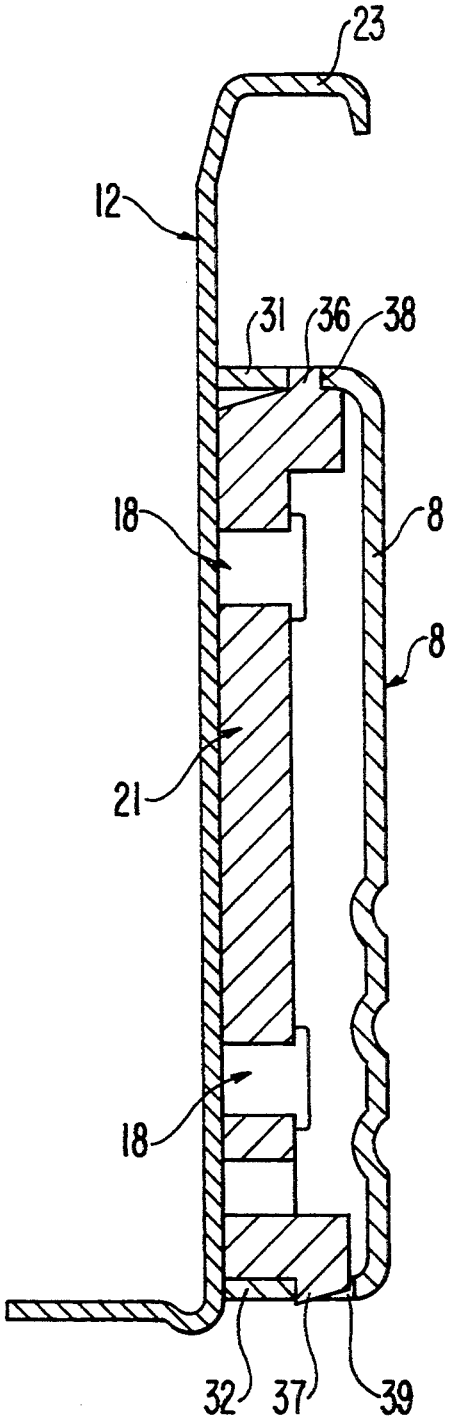
FIG. 14 shows a vertical section through a drawer frame according to a further embodiment of the invention.
Figure 15:
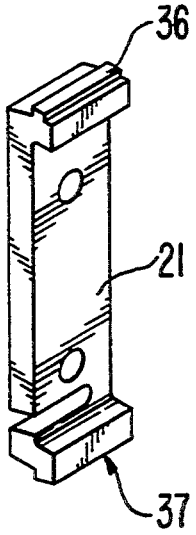
FIG. 15 shows a diagram of the mounting according to the embodiment in FIG. 14.
Figure 16:
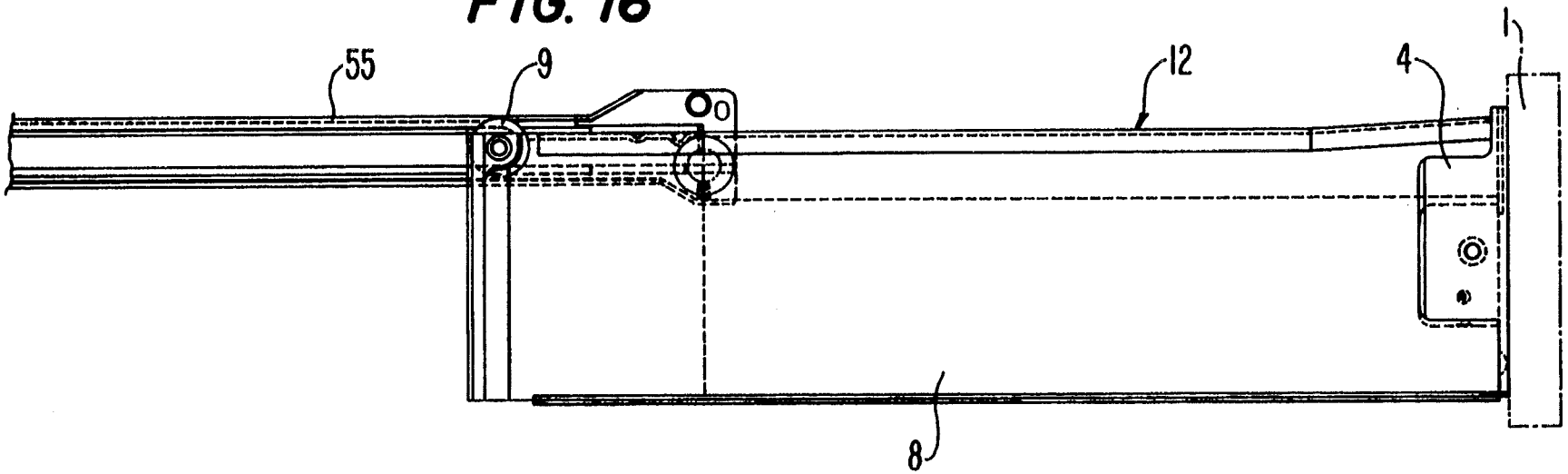
FIG. 16 shows a side view of a further embodiment of a drawer frame according to the invention.
Figure 17:
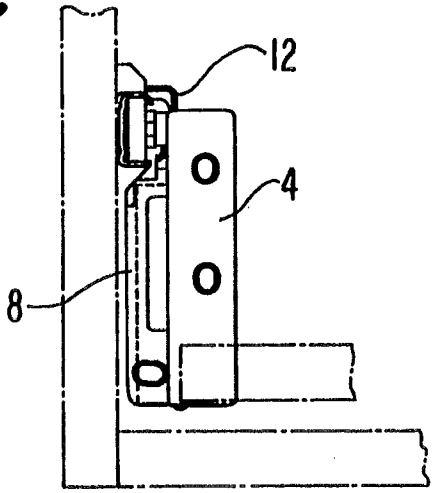
FIG. 17 shows a front view of a drawer frame according to the invention.
Figure 18:
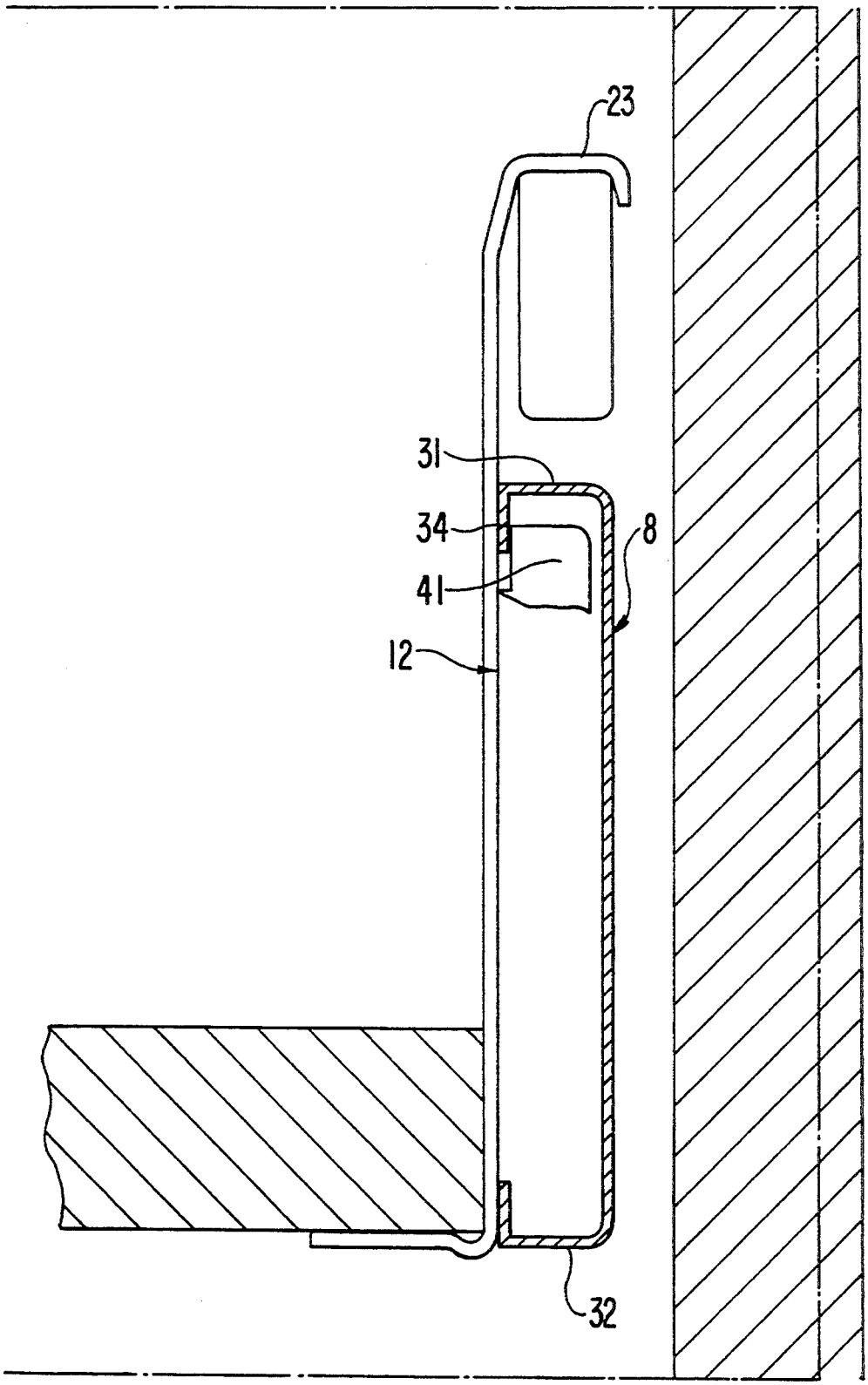
FIG. 18 shows a cross-section through a drawer frame according to the invention.
Figure 19:
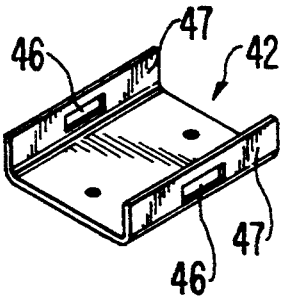
FIG. 19 shows a diagram of an intermediate piece.
Figure 20:
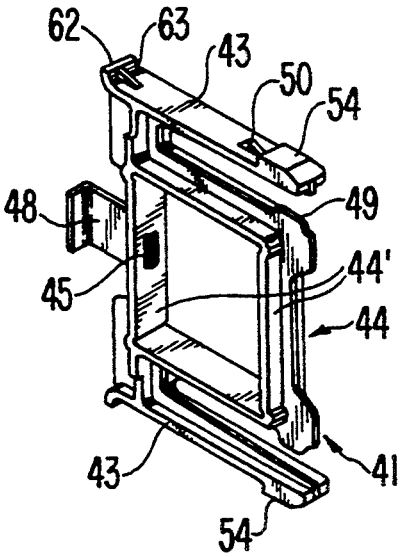
FIG. 20 shows a diagram of a mounting.
Figure 21:
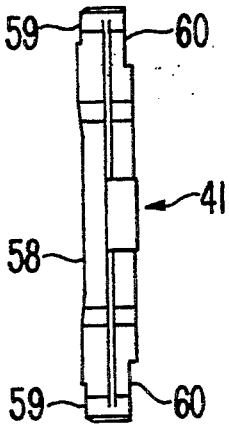
FIG. 21 shows an end view of a mounting.
Figure 22:
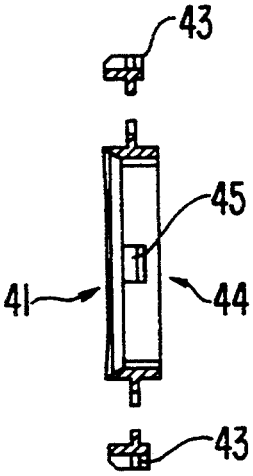
FIG. 22 shows a vertical section through a mounting.
Figure 23:
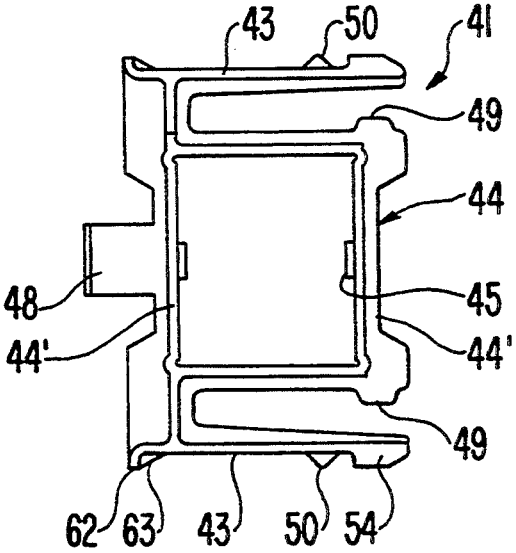
FIG. 23 shows a side view of a mounting.
Figure 25:
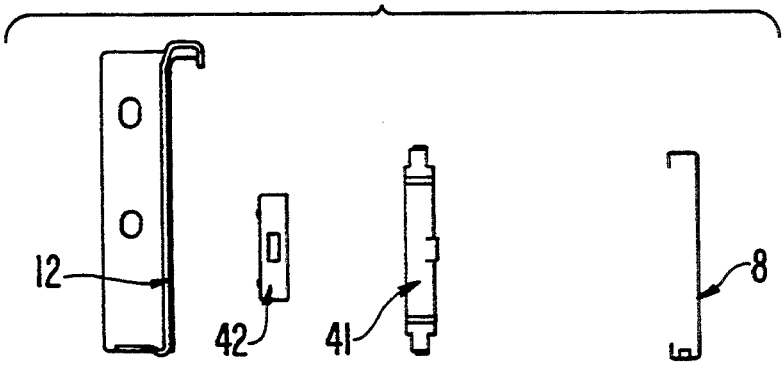
FIG. 25 shows diagrammatically and in exploded view the individual parts of the drawer frame.

In the embodiment in accordance with FIGS. 14 and 15, the mounting 21, which in turn is secured by means of rivets 18 or the like to the drawer frame, has an upper web 36 and a lower web 37, the lower web 37 corresponding to the lug 15. The upper web 36 projects into a slot 38 in the upper horizontal web 31 of the panel 8, and the lower lug-type web 37 projects into a slot 39 in the lower horizontal web 32 of the panel 8.

Here, the length of the slot 38 can be chosen such that it is possible to displace the panel 8 if the lug-type web 37 is pressed out of the opening 39.

Figure 24:
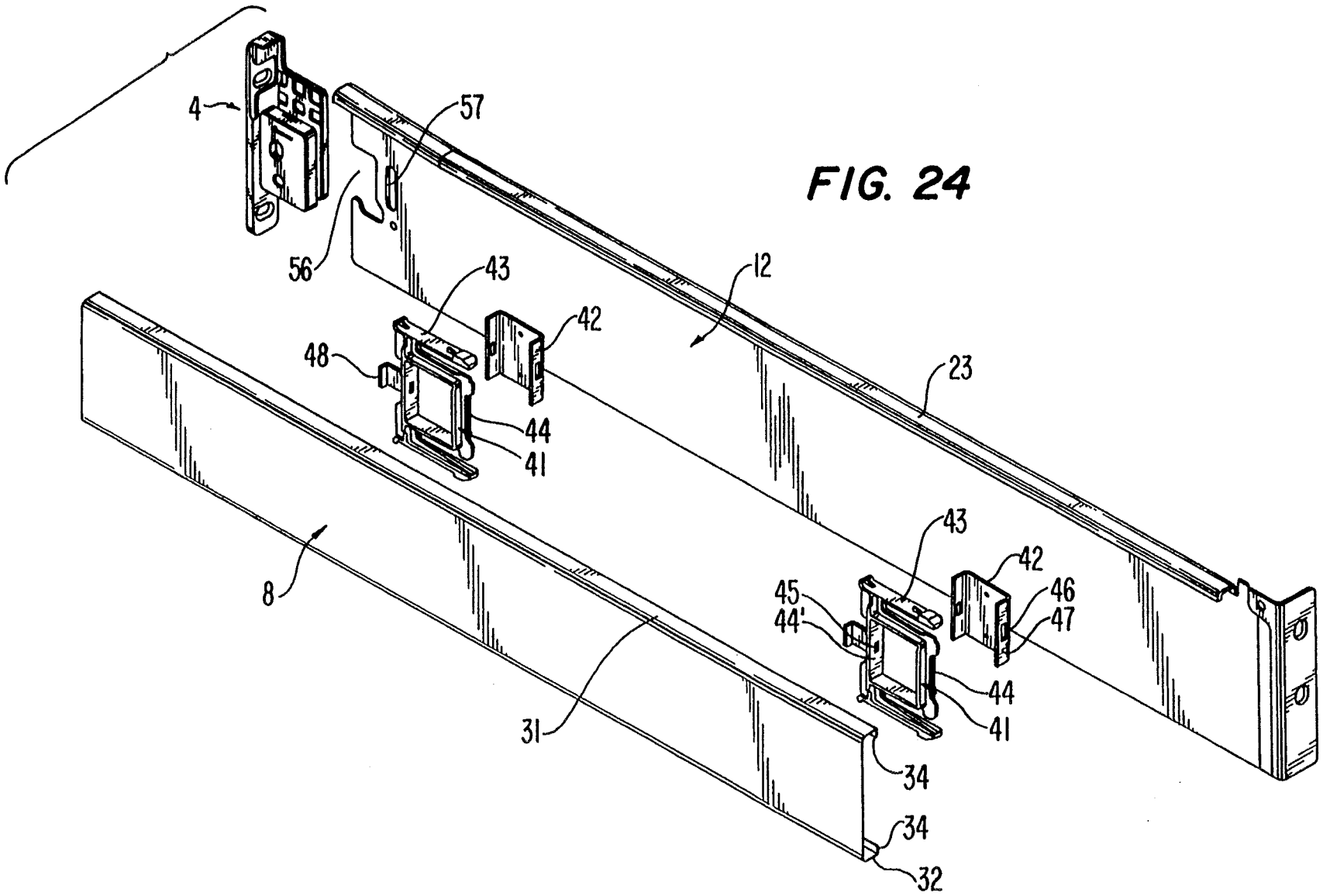
FIG. 24 shows an exploded drawing of the individual parts of the drawer frame according to the invention, as a diagram.
Figure 26:
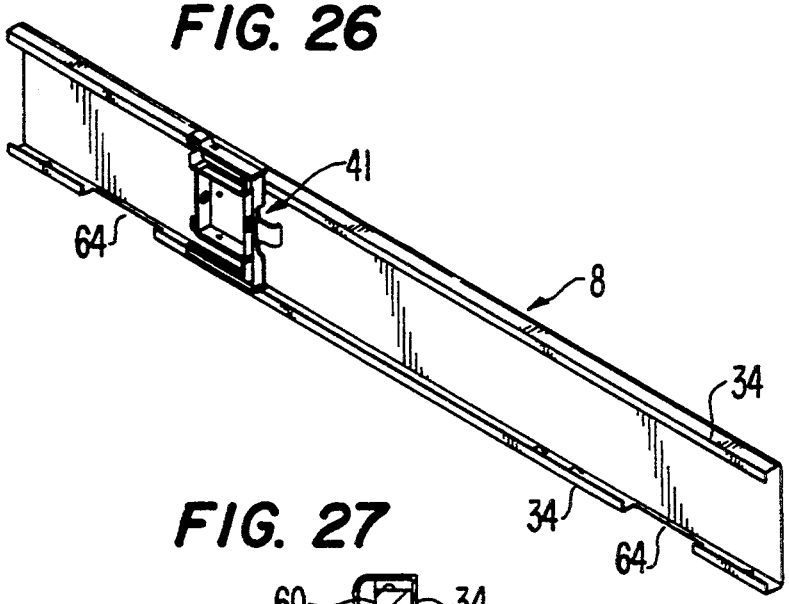
FIG. 26 shows a diagram of a panel and a mounting.
Figure 27:
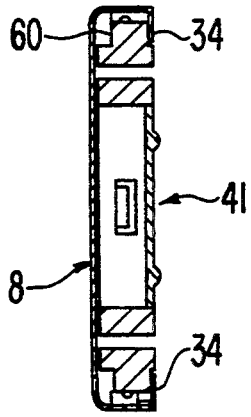
FIG. 27 shows a cross-section through a panel and a mounting.

In FIG. 24, openings 56, 57 in which the securing apparatus can be suspended for assembly of the drawer front panel 1 are shown at the front on the drawer frame 12.

In the embodiment in accordance with FIGS. 17 to 29, the mountings 41 can be clicked into place in the intermediate piece 42.

The intermediate pieces 42 are U-shaped, having two side webs 47 which are vertical in the mounted position, and are secured to the drawer frame 12, for example welded or riveted thereto.

The mountings 41 have a frame 44 on which arms 43 are integrally formed. On the inside of the vertical webs 44' of the frame 44' [sic] there are integrally formed lugs 45 which, when the mountings 41 are pressed onto the intermediate pieces 42, latch into the slot-shaped openings 46 in the intermediate pieces 42, as a result of which the mountings 41 are locked on the intermediate pieces 42.

The mountings 41 are constructed to be concave on the frame side and have a free interior 58, as a result of which slight flexing with respect to the drawer frame 12 and thus holding which is more snug are possible.

The arms 43 are provided with cutouts 59 in which the panel 8 latches by means of its edge webs 34 in the mounted position. Provided opposite the cutouts 59 are cutouts 60 which in turn enable the panel 8 to be suspended resiliently. Provided on one vertical web 34' is a resilient L-shaped tab 48 which in the mounted position presses against the panel 8 and thus ensures the latter is held firmly.

The arms 43 are resiliently movable with respect to the frame 44. Stops 49 which limit the spring travel are provided on the frame 44.

In the mounted position, the arms 43 press against the horizontal webs 31, 32 of the panel 8 by means of projections 61.

Furthermore, there are provided on the arms 43 lugs 50 which serve to pre-position the panel 8. Furthermore, spacing webs 62 and assembly ribs 63 are provided.

For assembly, the mountings 41 are pressed onto the intermediate pieces 42. The panel 8 can now be suspended in the mountings 41, the panel 8 being offset to the rear, that is to say the cutouts 56, 57 for the securing apparatus 4 and for the securing apparatus 4 as such remain free. In the lower edge web 34 and in the lower horizontal web 32, the panel 8 has cutouts 64 which enable the panel 8 to be suspended. Then, the panel 8 is displaced in the direction of the arrow in FIG. 29 until a claw 51, which is punched out of the lower horizontal web 32 or is integrally formed thereon, latches in between the projection 54 and the lug 50. The panel 8 is thus fixed to the drawer frame 12. However, the front securing means 4 is not covered, so that it is possible to adjust the front panel 1.

Once the front panel 1 has been adjusted, the panel 8 is pushed further until the claw 52 latches in between the projection 54 and the lug 50. The securing apparatus 4 for the front panel 1 is now covered, and the panel 8 is fixed in its final position.

Figure 28A:
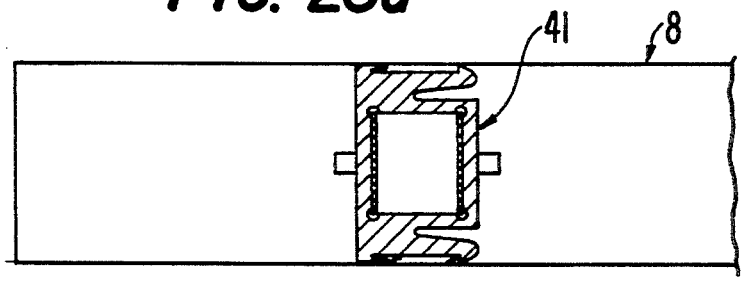
FIG. 28 shows a side view of a panel and a mounting.
Figure 28B:
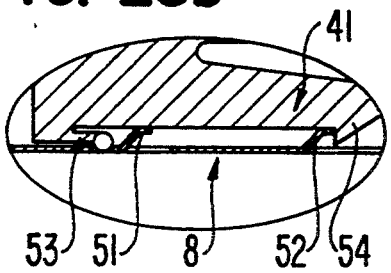
Figure 29:
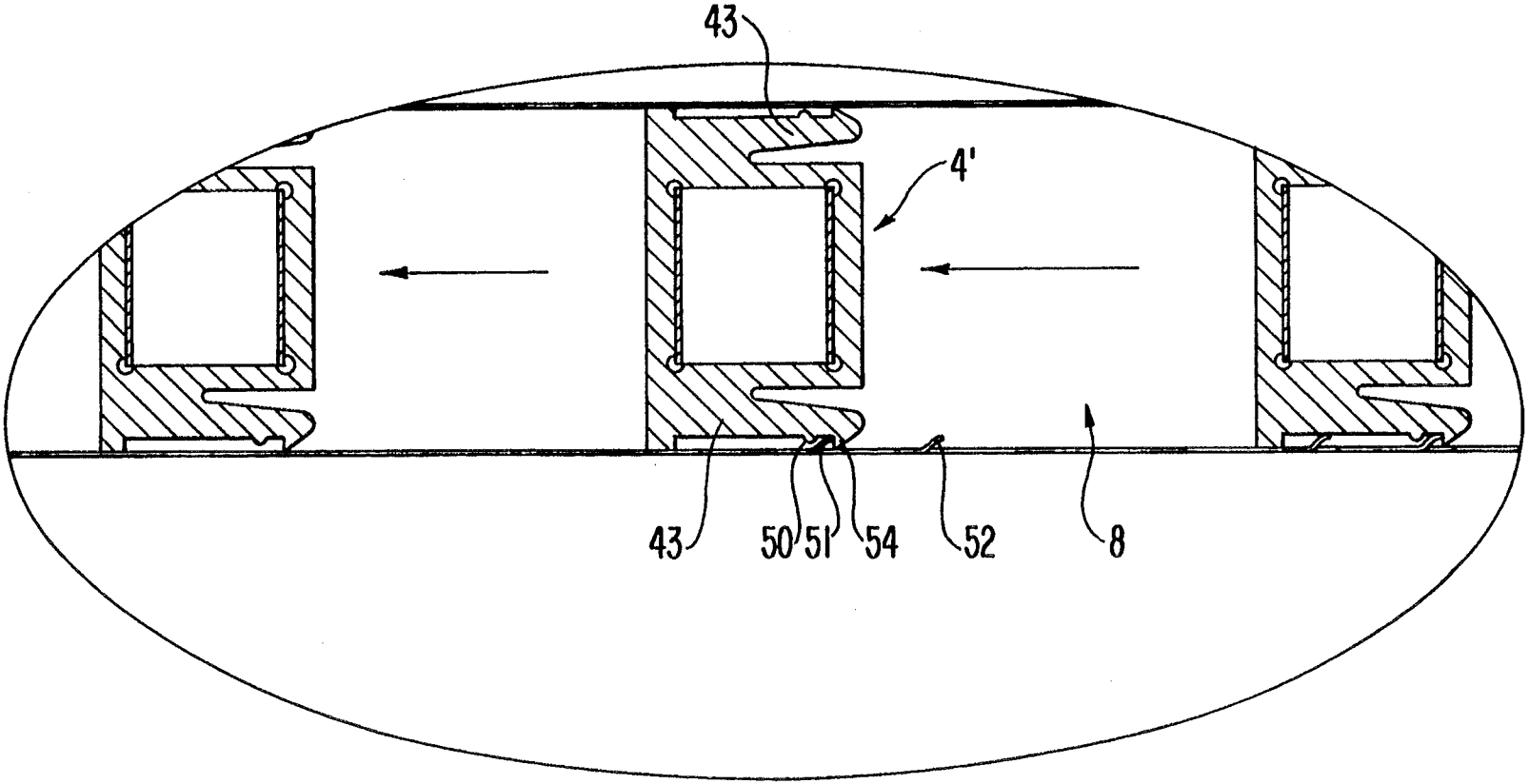
FIG. 29 shows a side view of a further embodiment of a panel and a mounting, the mounting being shown in various stages of assembly.

FIG. 28 shows an embodiment in which the claws 52 are supported on both sides on the mounting 41, as seen in the direction in which the panel 8 is displaced. The mounting 41 bears against the claw 52 by means of its projection 54 and has at the rear a stop 53 which comes to bear behind the claw 51.

What is claimed is:

1. A drawer side wall structure selectively convertible from a single wall configuration to a double wall configuration, said structure comprising:

an elongated drawer frame of single wall construction and formed of sheet steel, said drawer frame including a lower supporting web, a vertical web and an upper running web;

at least one mounting formed separately from and secured to said drawer frame;

an elongated panel separate from said drawer frame and including a vertical cover web; and said panel being selectively securable to said mounting such that said vertical cover web of said panel is spaced laterally from said vertical web of said drawer frame, thereby defining a double wall configuration.

2. A structure as claimed in claim 1, comprising plural mountings spaced longitudinally of said drawer frame.

3. A structure as claimed in claim 1, wherein said mounting has an assembly web bearing against said supporting web of said drawer frame.

4. A structure as claimed in claim 3, wherein said drawer frame includes a curved portion provided at a transition between said supporting web and vertical web, said curved portion being snugly received in a groove in said mounting.

5. A structure as claimed in claim 1, wherein said mounting includes a lower bearing web and an upper hook portion.

6. A structure as claimed in claim 5, wherein said panel includes an L-shaped edge web bearing on said lower bearing web and fitting into said upper hook portion, whereby said panel is suspended from said mounting.

7. A structure as claimed in claim 1, wherein said mounting includes a lug projecting into an opening in said panel.

8. A structure as claimed in claim 7, wherein said lug is provided on a flexible tab.

9. A structure as claimed in claim 1, wherein said panel has an upper web pressed laterally against said vertical web of said drawer frame.

10. A structure as claimed in claim 1, wherein said mounting includes at a top thereof a holding web that is laterally spaced from said vertical web of said drawer frame and defines therewith a gap, and said panel includes an edge web projecting into said gap.

11. A structure as claimed in claim 10, wherein said mounting includes at a bottom thereof a holding web that is laterally spaced from said vertical web of said drawer frame and defines therewith a gap, and said panel includes an edge web projecting into said gap.

12. A structure as claimed in claim 1, wherein said mounting includes at a bottom thereof a holding web that is laterally spaced from said vertical web of said drawer frame and defines therewith a gap, and said panel includes an edge web projecting into said gap.

13. A structure as claimed in claim 1, wherein said panel includes an upper horizontal web having therein a slot, and said panel has a holding web projecting into said slot.

14. A structure as claimed in claim 13, wherein said panel includes a lower horizontal web having therein a slot, and said panel has a holding web projecting into said slot.

15. A structure as claimed in claim 1, wherein said panel includes a lower horizontal web having therein a slot, and said panel has a holding web projecting into said slot.

16. A structure as claimed in claim 1, comprising two mountings, one said mounting having a lug projecting into a slot in said panel.

17. A structure as claimed in claim 16, wherein said slot is elongated, and said panel is displaceable relative to said lug.

18. A structure as claimed in claim 1, wherein said panel is displaceable longitudinally relative to said drawer frame.

19. A structure as claimed in claim 1, further comprising at least one intermediate member fixed directly to said drawer frame, said mounting being latched onto said intermediate member.

20. A structure as claimed in claim 19, comprising plural intermediate members spaced longitudinally of said drawer frame, and plural mountings, each said mounting being latched onto a respective said intermediate member.

21. A structure as claimed in claim 19, wherein said panel has a C-shaped transverse cross section and includes upper and lower horizontal webs extending from said vertical cover web, and said mounting has top and bottom resilient arms latched to and pressed toward said upper and lower horizontal webs, respectively.

22. A structure as claimed in claim 19, wherein said intermediate member has a U-shaped configuration including spaced parallel webs having respective openings, and said mounting has lugs latching into respective said openings.

23. A structure as claimed in claim 22, wherein said mounting includes a rectangular frame having two mutually opposing webs, said lugs being on respective said opposing webs.

24. A structure as claimed in claim 23, wherein said opposing webs extend vertically and are concave on sides thereof directed toward said drawer frame.

25. A structure as claimed in claim 19, wherein said mounting includes a frame having extending therefrom an integral resilient tab pressing against said vertical cover web of said panel.

26. A structure as claimed in claim 19, wherein said mounting includes a frame having extending therefrom top and bottom resilient arms, and said frame has stops to limit movement of said arms toward said frame.

27. A structure as claimed in claim 26, wherein at least one said arm has a stop and a projection, and said panel has at least two claws to latch with said stop and said projection.

28. A structure as claimed in claim 26, wherein at least one said arm has at least one lug, and said panel has at least one projection to latch with said lug.

29. A structure as claimed in claim 1, wherein said panel is securable to said mounting by being pushed thereon.

* * * * *